US008326203B2

(12) United States Patent
Ooyoshi

(10) Patent No.: US 8,326,203 B2
(45) Date of Patent: Dec. 4, 2012

(54) TONER CONVEYANCE DEVICE, PROCESS UNIT, AND IMAGE FORMING APPARATUS

(75) Inventor: Hirobumi Ooyoshi, Toyonaka (JP)

(73) Assignee: Ricoh Company, Ltd., Tokyo (JP)

( * ) Notice: Subject to any disclaimer, the term of this patent is extended or adjusted under 35 U.S.C. 154(b) by 357 days.

(21) Appl. No.: 12/801,890

(22) Filed: Jun. 30, 2010

(65) Prior Publication Data

US 2011/0002720 A1 Jan. 6, 2011

(30) Foreign Application Priority Data

Jul. 2, 2009 (JP) ..... 2009-157775

(51) Int. Cl.
*G03G 21/00* (2006.01)

(52) U.S. Cl. ..... 399/359

(58) Field of Classification Search ..... 399/359, 399/358, 360, 120
See application file for complete search history.

(56) References Cited

U.S. PATENT DOCUMENTS

| | | | | |
|---|---|---|---|---|
| 5,848,342 | A * | 12/1998 | Tanda | 399/358 |
| 7,424,263 | B2 | 9/2008 | Shimizu | |
| 7,623,821 | B2 | 11/2009 | Kubota | |
| 7,634,213 | B2 | 12/2009 | Yoshida | |
| 2007/0081839 | A1 * | 4/2007 | Min et al. | 399/358 |
| 2007/0104523 | A1 | 5/2007 | Yoshida | |
| 2007/0140763 | A1 | 6/2007 | Shimizu | |
| 2007/0248390 | A1 | 10/2007 | Kubota | |
| 2008/0089727 | A1 | 4/2008 | Shimizu | |
| 2008/0095559 | A1 | 4/2008 | Shimizu | |
| 2008/0145119 | A1 | 6/2008 | Tatsumi | |
| 2008/0152408 | A1 | 6/2008 | Kawakami | |
| 2008/0170898 | A1 | 7/2008 | Shimizu | |
| 2008/0181692 | A1 | 7/2008 | Tatsumi | |
| 2008/0199234 | A1 * | 8/2008 | Hagi et al. | 399/359 |
| 2008/0205930 | A1 | 8/2008 | Kawakami | |
| 2008/0267661 | A1 | 10/2008 | Yoshida | |
| 2008/0279586 | A1 | 11/2008 | Tatsumi | |
| 2009/0022531 | A1 | 1/2009 | Kubota | |
| 2009/0110430 | A1 | 4/2009 | Kubota | |
| 2009/0154973 | A1 | 6/2009 | Shimizu | |
| 2009/0162101 | A1 | 6/2009 | Yoshida | |
| 2009/0169246 | A1 | 7/2009 | Ooyoshi | |
| 2009/0169265 | A1 | 7/2009 | Yoshida | |
| 2010/0028045 | A1 | 2/2010 | Kawakami | |

FOREIGN PATENT DOCUMENTS

| | | |
|---|---|---|
| JP | 2007-065143 | 3/2007 |
| JP | 2008-122925 | 5/2008 |
| JP | 2008-175956 | 7/2008 |

* cited by examiner

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

A toner conveyance device includes a toner conveyance path to convey toner from a lower position to an upper position, a lower holding member and an upper holding member provided in the toner conveyance path, a toner conveyance belt extended among the upper holding member and the lower holding member, running obliquely upward at a lower-side region, running obliquely downward at an upper-side region, and including engagement grooves communicating an inner side and outer side of the conveyance belt formed at predetermined intervals in a running direction of the conveyance belt so as to transfer a drive force, and a guide member provided inside a circulating loop of the conveyance belt to prevent the conveyance belt from entering inside. The lowest portion of the guide member at the upper-side region is placed on a substantially vertical line drawn from a belt delivery part of the lower holding member.

11 Claims, 11 Drawing Sheets

TONER CONVEYANCE DEVICE, PROCESS UNIT, AND IMAGE FORMING APPARATUS

The present patent application claims priority pursuant to 35 U.S.C. §119 from Japanese Patent Application No. 2009-157775, filed on Jul. 2, 2009 in the Japan Patent Office, which is hereby incorporated by reference herein in its entirety.

BACKGROUND OF THE INVENTION

1. Field of the Invention

The present invention relates to an image forming apparatus, and more particularly to an image forming apparatus that is capable of smooth and efficient toner conveyance.

2. Discussion of the Background

Related-art image forming apparatus, such as copying machines, facsimile machines, printers, or multifunction printers having two or more of copying, printing, scanning, and facsimile functions, include a developing device.

FIG. 1 is a typical developing device used in an image forming apparatus. As shown in FIG. 1, the developing device includes a developing roller 103, a supply roller 104, a blade 102, a toner hopper unit 107 and a toner agitator 105. The supply roller 104 is a rotary body and has an outer circumferential sponge layer. The supply roller 104 is rotated in the same direction as the developing roller 103. While rotating, the supply roller 104 captures toner with the sponge layer to supply it to the developing roller 103.

The blade 102 is formed of a plate spring made of metal. When a top portion of the blade is pressed against the surface of the developing roller 103, a thin toner layer is spread uniformly over the surface of the developing roller 103.

The toner agitator 105 is provided in the toner hopper unit 107. By rotating the toner agitator 105, the toner agitator 105 agitates the toner stored in the toner hopper unit 107. The developing roller 103 is a rotary body and has an outer circumferential rubber layer.

The developing roller 103 contacts the surface of the photoconductor 101 that is an image carrier. The thin toner film layer uniformly formed on the surface of the developing roller 103 by the blade 102 is transferred onto the surface of the photoconductor 101 to form an toner image.

Toner on the surface of the photoconductor 101 is transferred onto a sheet of paper or a transfer belt, not shown. However, residual toner that is not transferred but remains on the photoconductor 101 is scraped off by a cleaning blade 108 that is elastic and is pressed against the photoconductor 101. These processes are repeated, and the toner scraped off by the cleaning blade 108 is accumulated in a cleaning unit 109 for the photoconductor 101.

Unused toner accumulated in the cleaning unit 109 for the photoconductor 101 may be reused by returning it to the developing unit, or not reused but just collected.

Over time, paper particles and duct may adhere to the surface of the photoconductor 101. Further, in a color image forming apparatus that uses a plurality of color toners, toner of other colors may be adhered to the surface of the photoconductor 101. These particles are mixed with the toner scraped off from the photoconductor 101, and if returned to the developing unit, the recycled toner may contain more impurities than fresh toner. As a result, it is difficult to maintain high image quality. Consequently, in most image forming apparatuses other than monochrome printers, the toner scraped off from the photoconductor 101 is not reused but is just collected.

When the toner is collected, the toner accumulates in the cleaning unit 109 for the photoconductor 101. Accordingly, the cleaning unit 109 is designed to have sufficient volume to store the accumulated toner.

By contrast, when the toner is reused, a conveyance mechanism is necessary to convey the collected toner from the cleaning unit to the developing unit. In both cases, it is necessary to convey toner from the cleaning unit to the other unit.

To convey toner (waste toner), a conveyance belt as shown in FIG. 2 may be used. More specifically, a conveyance belt 111 is provided in a conveyance path 112 to tilted at a predetermined angle with respect to the vertical. The conveyance belt 111 is extended around a driving shaft 113 provided at an upper part of the conveyance path 112 and a roller 114 provided at a lower part of the conveyance path 112. Projections 116 are formed on the driving shaft 113 that engages an engagement groove, not shown, formed in both sides of the conveyance belt 111 to transfer the driving force of the driving shaft 113 to the conveyance belt 111.

When the driving shaft 113 is driven, the conveyance belt 111 is moved in a direction shown by arrow A in FIG. 2. Further, projections and depressions 115 are formed on an outer surface of the conveyance belt 111. Accordingly, when the conveyance belt 111 is moved, the toner T is conveyed from the lower part to the upper part of the conveyance path 112. The toner T scraped off from the photoconductor 101 is supplied to a lower position of the conveyance belt 111 by, for example, a lower conveyance screw. Further, an upper conveyance screw is juncturally provided on the driving shaft 113. The toner T is conveyed to a waste toner collection unit by the upper conveyance screw. It is to be noted that although in the example shown in FIG. 2 the projections and depressions 115 are represented for only a part of the conveyance belt 111, the projections and depressions 115 are actually formed along the entire surface of the conveyance belt 111.

Since the driving shaft 113 applies pressure on the conveyance belt 111, the tension on the conveyance belt 111 is relatively high at an upstream end of the driving shaft 113 and relatively low at a downstream end of the driving shaft 113. Accordingly, the conveyance belt 111 may sag, with the possibility that the conveyance belt 111 gets caught by and entangled with the driving shaft 113.

To avoid such a problem, a rib member 122 may be provided along a line connecting the axes of the roller 114 with a shaft center of the driving shaft 113 as shown in FIG. 2. In this case, a gap between the rib member 122 and the driving shaft 113 is set as small as possible so that the conveyance belt 111 is not caught by the driving shaft 113 knocking against the rib member 122.

In the toner conveyance device shown in FIG. 2, it is desired that the toner conveyed be scraped off completely at a portion of the conveyance belt 111 wrapped around the driving shaft 113. However, even if that removal is accomplished, the toner may still build up on the projections and depressions 115 of the conveyance belt 111. As a result, it is difficult to completely remove the toner adhered even with a scraper like that described in Japanese Patent Laid-Open Application Publication No. 2008-175956-A, for reasons that are described below.

In addition, when the conveyance belt 111 on which the toner is adhered is moved, the toner may get onto the conveyance belt 111 through the engagement grooves that transfer the rotational drive force. Consequently, toner is constantly flying in and around the toner conveyance path because the conveyance belt 111 on which the toner is adhered is moved and the toner is conveyed by the conveyance belt 111. Accordingly, the toner may gradually accumulate at areas outside that portion of the toner conveyance path through which the conveyance belt 111 moves, which is undesirable.

Further, the toner may accumulate in a space between the rib member 122 for preventing the circulating conveyance belt 111 from being caught and the conveyance belt 111. Thereafter, the toner may be moved to the roller 114 provided downstream in the circulating direction by some impact or friction generated by the circulation of the conveyance belt 111. In such case, since the conveyance belt 111 is circulated, the toner may be captured in a space between the roller 114 and the conveyance belt 111 to shift outward by an amount equal to the thickness of the toner T captured. Since the conveyance belt 111 is traveling with a predetermined but generally relatively narrow gap between it and a wall surface of components that define the toner conveyance path, any outward displacement of the conveyance belt 111 entails a risk that the conveyance belt 111 may get hung up on the wall surface of the toner conveyance path.

The above-described situation is not improved with the removal of the intermediate rib member. FIG. 3 is a toner conveyance device lacking the rib member 122. In such toner conveyance device, the toner is flying about in the vicinity of the wall surface of the toner conveyance path and gradually piles up against a wall 127 perpendicular to the moving direction of the conveyance belt 111 (that is, on a plane parallel to the sheet of paper on which FIG. 3 is drawn).

Moreover, normally the toner does not collapse while the conveyance belt 111 moving. However, when the toner is subject to some impact, the toner does not collapse and move. In such case, similarly to the toner conveyance device having a rib member 122, the toner collapsed and moved is captured in the space between the roller 114 and the conveyance belt 111, shifting the traveling position of the conveyance belt 111 outward by an amount equal to the amount of the toner T thus accumulated. Consequently, the conveyance belt 111 may get hung up on the wall surface as described above.

SUMMARY OF THE INVENTION

This patent specification describes a novel image forming apparatus that includes a toner conveyance device including a toner conveyance path, a lower holding member, an upper holding member, a conveyance belt, and a guide member. The toner conveyance path is provided to convey toner from a lower position to an upper position. The lower holding member is provided at the lower position in the toner conveyance path and defining a belt delivery part. The upper holding member is provided at the upper position in the toner conveyance path. The conveyance belt is extended around the upper holding member and the lower holding member and driven to circulate by the upper holding member working in conjunction with the lower holding member. The conveyance belt runs obliquely upward at a lower-side region, runs obliquely downward at an upper-side region, and includes a projection to hold and convey the toner with a wall of the toner conveyance path and engagement grooves communicating an inner side with an outer side of the conveyance belt, formed at predetermined intervals in a running direction of the conveyance belt so as to transfer a drive force to the conveyance belt. The guide member is provided in a space inside a circulating loop formed by the conveyance belt to prevent the conveyance belt from collapsing. The lowest portion of the guide member at the upper-side region is placed on a substantially vertical line drawn from the belt delivery part of the lower holding member at the lower-side region.

This patent specification further describes a novel image forming apparatus which includes the toner conveyance device described above. The configuration of the toner conveyance device may satisfy the following relation, $$R/2<L<(\sin\theta+(\cos\theta+1)/\tan\theta)\times R:$$

where the radius of the roller is "R", a distance between a shaft center of the driven roller and the lowest portion of the guide member at the upper-side region is "L", and an angle of the conveyance belt with respect to a horizontal line is "θ".

The upper holding member may be a drive shaft and the lower holding member may be a roller.

The guide member may be a flat, rib like member and may include a plurality of slits through which the toner can flow from the upper-side region to the lower-side region of the conveyance path.

The guide member may include a toner drop guard unit formed at lower portion thereof and extending towards the conveyance belt in the lower-side region to prevent toner in a region below the guide member from dropping onto the lower holding member.

The above-described toner conveyance device may further include a toner entry prevention unit provided at or near an inner surface of the conveyance belt to scrape off toner adhering to the inner surface of the conveyance belt.

The lower holding member may be a non-rotating member. A configuration of the toner conveyance device may satisfy a relation of L≈J, where a distance between a shaft center of the non-rotating member and the lowest portion of the guide member at the upper-side region is "L" and a distance between the shaft center of the non-rotating member and an outer edge of a straight section of the non-rotating member at the lower-side region is "J".

The above-described toner conveyance device may further include a toner entry prevention unit provided on the lower holding member.

The lower holding member may be a non-rotating member. A configuration of the toner conveyance device may satisfy a relation of L≈J, where a distance between a shaft center of the non-rotating member and the lowest portion of the guide member at the upper-side region is "L" and a distance between the shaft center of the non-rotating member and an outer edge of a tilt section of the non-rotating member at the lower-side region is "J".

This patent specification further describes a novel process unit that is detachably attachable to the novel image forming apparatus. The process unit includes an image carrier configured to bear an electrostatic latent image thereon, a developing unit configured to develop an electrostatic latent image formed on the image carrier, and the above-described toner conveyance device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
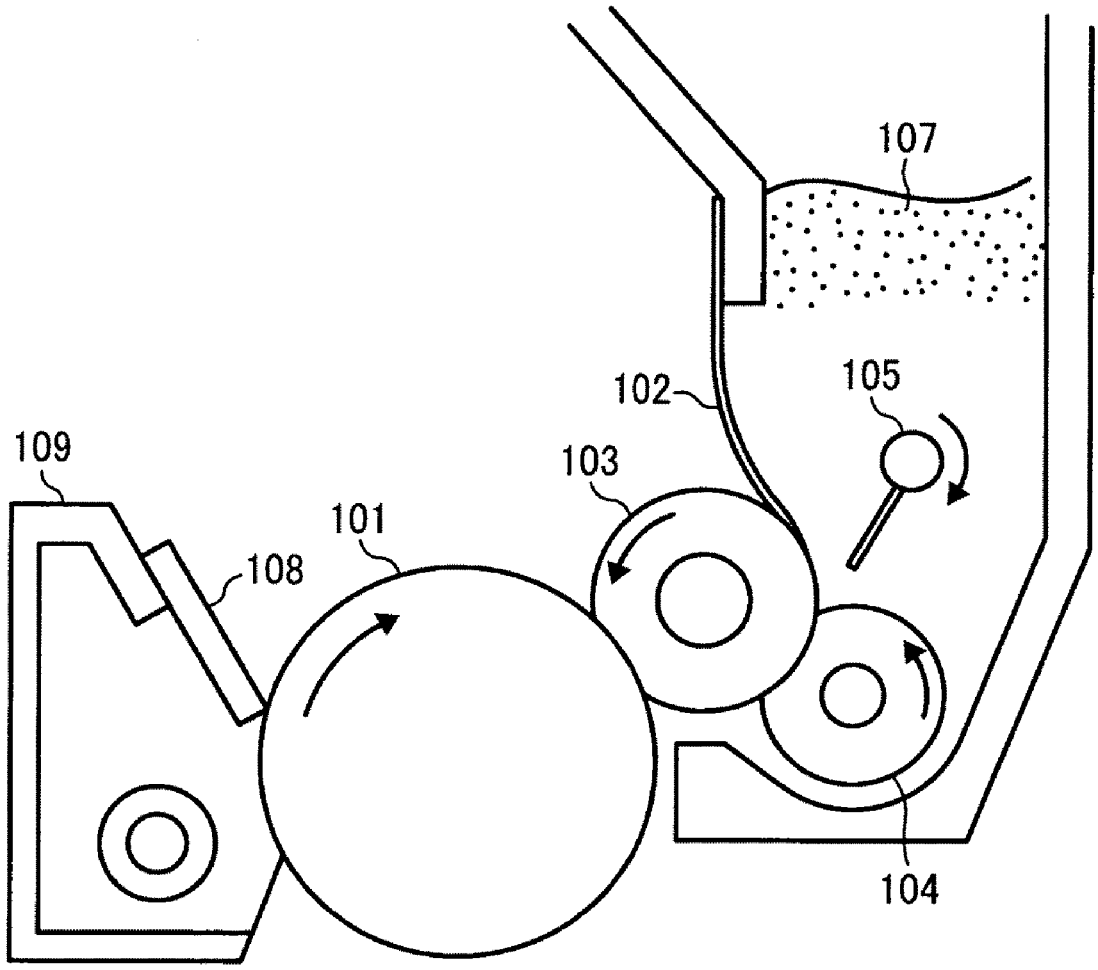
FIG. 1 BACKGROUND ART
FIG. 1 is a schematic configuration of a background art developing device.
Figure 2:
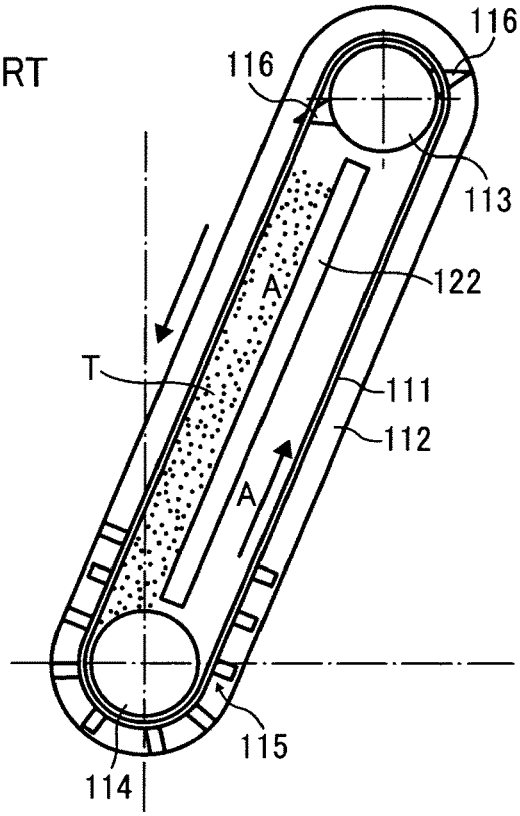
FIG. 2 BACKGROUND ART
FIG. 2 is a schematic configuration of a toner conveyance device incorporated in the developing device of FIG. 1.
Figure 3:
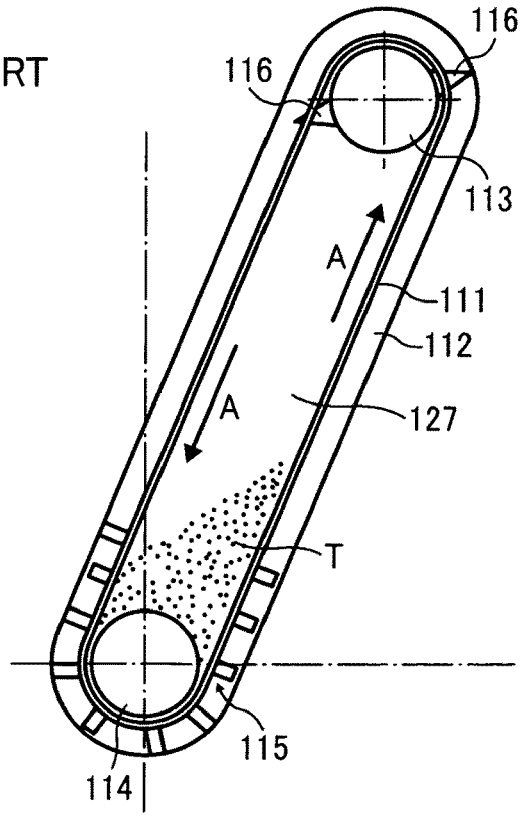
FIG. 3 BACKGROUND ART
FIG. 3 is a schematic configuration of another toner conveyance device incorporated in the developing device of FIG. 1.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 4:
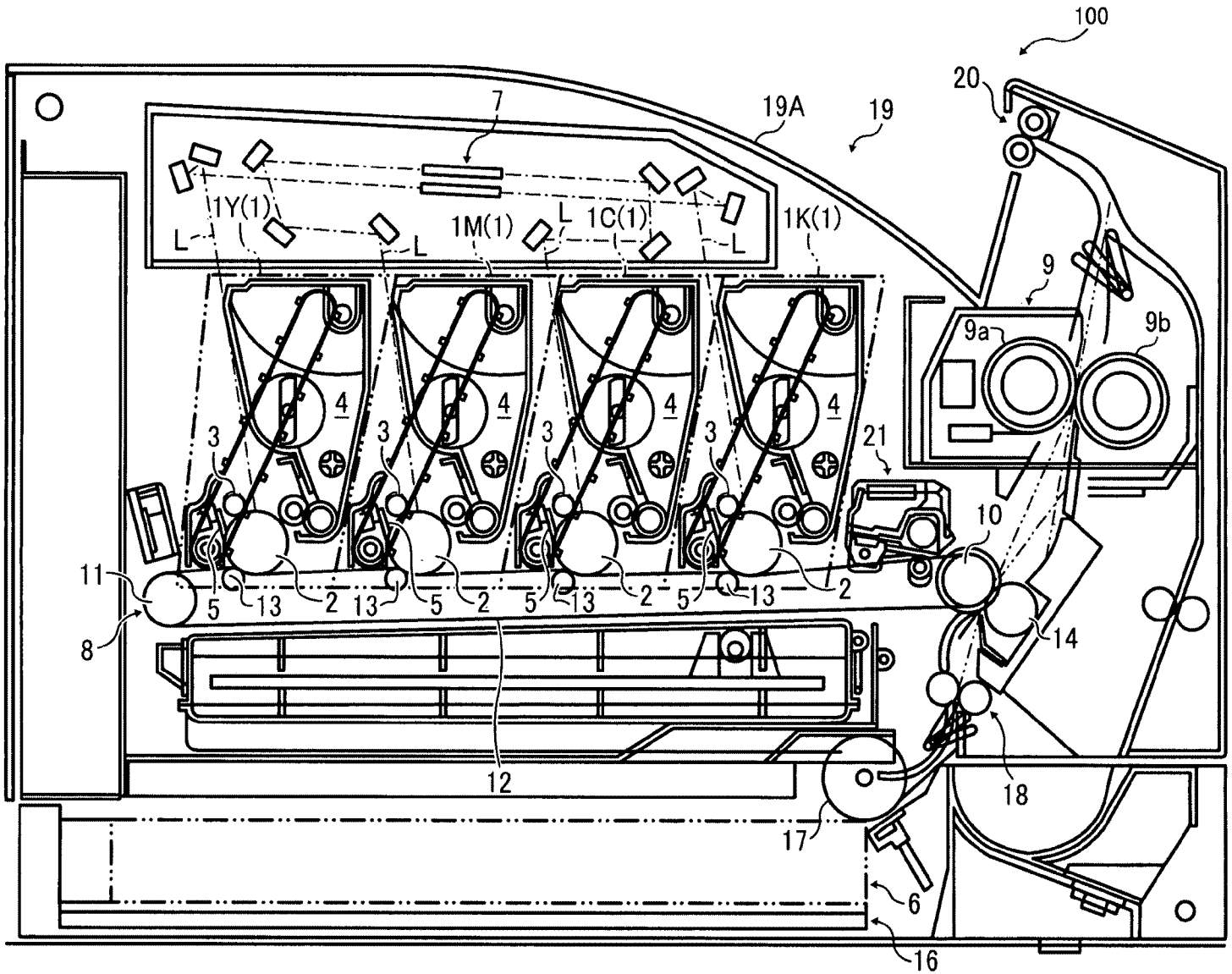
FIG. 4 is a schematic total view of an image forming apparatus according to a first embodiment of the present invention.

Referring now to the drawings, wherein like reference numerals designate identical or corresponding parts throughout the several views, particularly to FIG. 4, an image forming apparatus according to an embodiment of the present invention is described.

FIG. 4 is a first example embodiment of an image forming apparatus 100 according to the present invention. The image forming apparatus includes four process units 1K, 1C, 1M, and 1Y to form an image using color developer components black (K), cyan (C), magenta (M), and yellow (Y), respectively.

The four process units 1K, 1C, 1M, and 1Y are detachably provided in a main body of the image forming apparatus 100, to allow replacement of a consumable part at one time. The process units 1K, 1C, 1M, and 1Y are essentially identical except for the color of the toner stored therein. Accordingly, a configuration of the process unit 1 is described with reference to only one of the process units, with the suffixes "K", "C", "M", and "Y" that designate color are omitted.

The process unit 1 includes a photoconductor 2, a charging roller 3, a developing unit 4, and a cleaning blade 5. The photoconductor 2 serves as an image carrier that carries an electrostatic latent image. The charging roller 3 is a charging mechanism that charges a surface of the photoconductor 2. The developing unit 4 forms a toner image by supplying toner to the electrostatic latent image formed on the surface of the photoconductor 2. The cleaning blade 5 removes residual toner remaining on the surface of the photoconductor 2 after image formation.

Further, the image forming apparatus 100 according to the present invention includes an exposure unit 7, an intermediate transfer unit 8, a fixing unit 9, and a recording medium supply unit 6. The exposure unit 7 forms the electrostatic latent image on the surface of the photoconductor 2. The intermediate transfer unit 8 transfers an image formed by the process unit onto a recording medium such as a sheet of paper. The fixing unit 9 fixes the image on the recording medium. The recording medium supply unit 6 supplies the recording medium.

The intermediate transfer unit 8 includes an intermediate transfer belt 12 that is an endless belt and is extended among a drive roller 10 and driven roller 11.

At an inner surface of the intermediate transfer belt 12, four primary rollers 13 that are primary transfer mechanisms are provided. Each primary roller 13 presses against the inner surface of the intermediate transfer belt 12 at a position where the primary roller 13 faces each photoconductor 2. Since the primary roller 13 is pressed, each photoconductor 2 is pressed against the outer surface of the intermediate transfer belt 12, to form a primary transfer nip at the position where the primary roller 13 is pressed.

A secondary roller 14, which is a secondary transfer mechanism, is provided to face the drive roller 10 which the intermediate transfer belt 12 is extended among.

The secondary roller 14 is pressed against the outer surface of the intermediate transfer belt 12. A secondary transfer nip is formed at the position where the secondary roller 13 is pressed. Further, at the outer surface of the intermediate transfer belt 12, a belt cleaning unit 21 is provided to clean the surface of the intermediate transfer belt 12.

The fixing unit 9 includes a fixing roller 9*a* and a pressure roller 9*b*. The fixing roller 9*a* includes a heat source. The pressure roller 9*b* touches the fixing roller 9*a*. A fixing nip is formed at a position where the fixing roller 9*a* faces the pressure roller 9*b*. The recording medium supply unit 6 includes a recording medium storage unit 16 and a supply roller 17. The recording medium storage unit 16 stores recording medium such as sheets of paper. The supply roller 17 feeds the recording medium from the recording medium storage unit 16. On the way between the recording medium storage unit 16 and the drive roller 10, a pair of resist rollers 18 is provided to hold the recording medium temporarily.

At an upper part of the fixing unit, a pair of output rollers 20 is provided to output the recording medium. The recording medium output by the output roller 20 is accumulated in a stock 19. A part of an upper cover 19A of the main body of the image forming apparatus may be lowered towards inside to form the stock 19.

Referring to FIG. 4, basic operations of the image forming apparatus will be now described.

In one image forming unit 1K, the surface of the photoconductor 2 is charged uniformly by the charging roller 3. A laser beam L emitted from the exposure unit 7 is directed onto the surface of the photoconductor 2 based on image data. A potential at a portion of the surface of the photoconductor 2 exposed by the laser beam is decreased, forming an electrostatic latent image.

Toner charged by the developing unit 4 is transferred electrostatically to the electrostatic latent image formed on the surface of the photoconductor 2 to form a visible toner image. Respective color toner images are similarly formed in the other process units 1C, 1M, and 1Y.

The toner images formed on each photoconductor 2 are transferred successively onto the intermediate transfer belt 12, which is driven to circulate, by superimposing the color images one atop the other. After the transfer process, residual toner adhering to the surface of the photoconductor 2 is removed by the cleaning blade 5.

The recording medium stored in the recording medium storage unit 16 is fed by the supply roller 17 and is held temporarily by the resist rollers 18. As described previously, after the toner image is transferred onto the intermediate transfer belt 12, the resist rollers 18 are driven again to convey the recording medium to a secondary nip formed by the secondary roller 14 and the drive roller 10 with a predetermined timing to match the arrival of the toner image formed on the intermediate transfer belt 12 thereat. Then, at the secondary nip, the toner image formed on the intermediate transfer belt 12 is transferred onto the recording medium conveyed to the secondary nip.

The recording medium on which the toner image is transferred is conveyed to the fixing unit 9, where it is held by the fixing nip formed by the fixing roller 9*a* and the pressure roller 9*b* and heated and pressed to fix the toner image on the recording medium.

Figure 5:
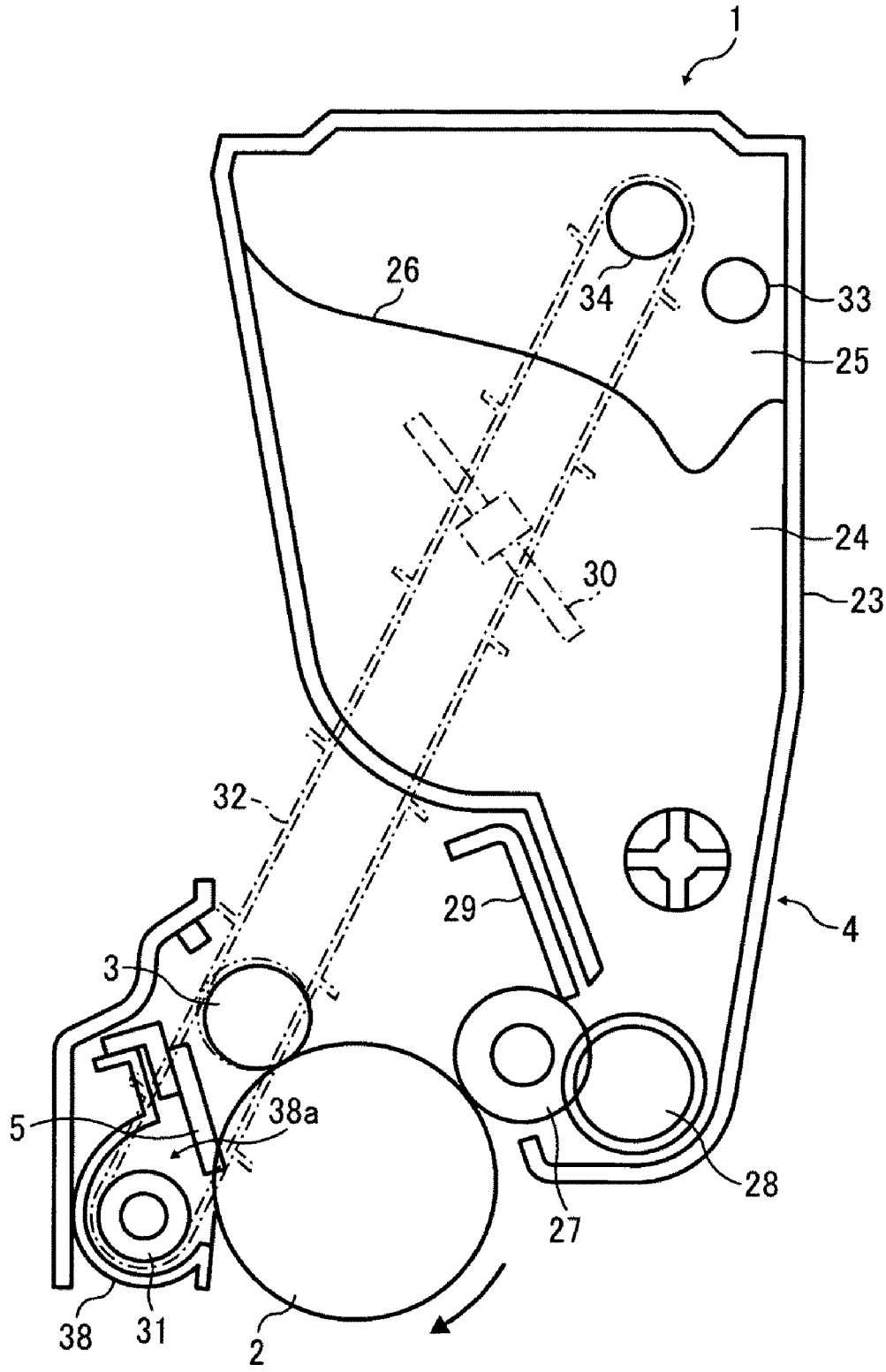
FIG. 5 is a schematic configuration representing a process unit provided in the image forming apparatus of FIG. 4.

FIG. 5 is a schematic drawing of the process unit 1. As shown in FIG. 5, the developing unit 4 includes a developer storage 23, a development sleeve 27, a developer supplying roller 28, and a blade 29. The developer storage 23 includes a new toner storage 24 and a waste toner storage 25. The developer supplying roller 28 supplies new toner to the development sleeve 27 to convey the toner to the photoconductor 2. The blade 29 regulates the thickness of the toner on the development sleeve 27. A separation wall 26 separates the new toner storage 24 from the waste toner storage 25. Further, in the new toner storage 24, an agitator 30 is provided to agitate the new toner.

The separation wall 26 may be a plastic sheet-like member. It is possible to change the position of the separation wall 26 towards either the new toner storage unit 24 or the waste toner storage unit 25. When the new toner in the new toner storage unit 24 is decreased and the waste toner is collected in the waste toner storage unit 25, the separation wall 26 is pressed down by the weight of the waste toner.

Figure 6:
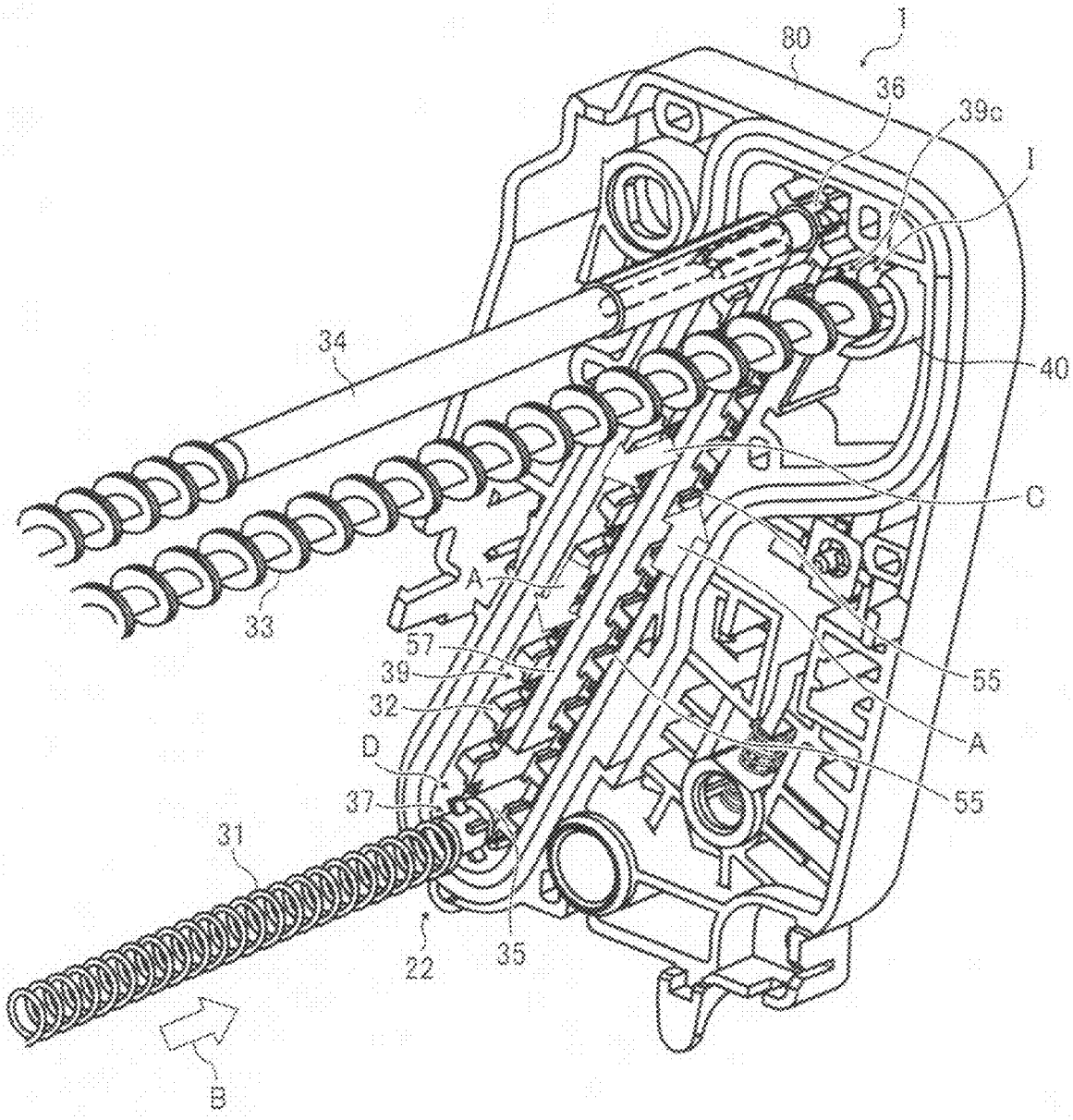
FIG. 6 is a perspective view of a relevant part of the process unit.

The process unit 1 includes a toner conveyance device 22 that conveys the waste toner to the waste toner storage 25 as shown in FIG. 6. The toner conveyance device 22 conveys the waste toner from lower position to upper position. In this example embodiment, the toner conveyance device 22 includes a lower conveyance screw (conveyance coil) 31 provided at a lower part in FIG. 6, a conveyance belt 32 provided in a vertical direction of FIG. 6, and an upper conveyance screw 33 provided at an upper part of FIG. 6, a driven roller 35, and a drive shaft 36.

In FIG. 5, underneath the cleaning blade 5, a toner receiving unit 38 having an opening 38*a* faces the cleaning blade 5. The toner receiving unit 3 is provided along the photoconductor 2 in an axial direction of the photoconductor 2. The conveyance coil 31 is provided in the toner receiving unit 38.

Further, as shown in FIG. 5, the upper conveyance screw 33 is provided in the waste toner storage unit 25, which in turn is provided with an agitation screw 34 parallel to the upper conveyance screw 33.

Figure 9:
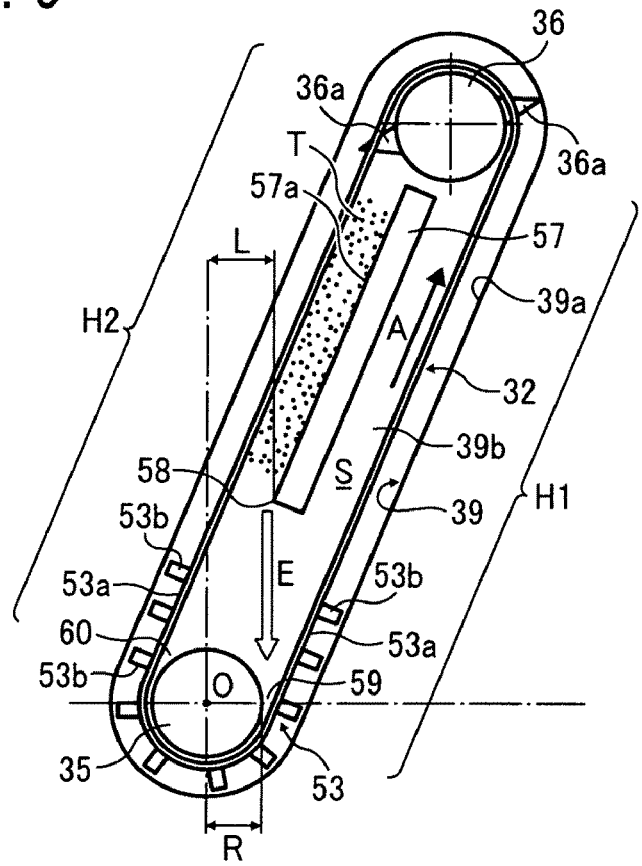
FIG. 9 is a schematic structure of the relevant part of the conveyance belt of the toner conveyance device of FIG. 7.

The conveyance belt 32 is an endless belt circulating in a loop toner conveyance path 39. As shown in FIG. 9, the conveyance belt 32 is looped over a pair of holding members, which are an upper holding member and a lower holding member, rotatably provided in the toner conveyance path 39. In this example embodiment, the upper holding member is a drive shaft 36 coupled to a drive mechanism, not shown. The lower holding member provided at lower part in the toner conveyance path 39 and is a driven roller 35. Thus, the conveyance belt 32 is extended among two shafts in this embodiment. Alternatively, however, the conveyance belt 32 may be extended among three or more shafts.

In this example embodiment, the driven roller 35 is connected to one end of the conveyance coil 31 as shown in FIG. 6. The drive shaft 36 is connected to one end of the agitation screw 34. Another end of the agitation screw 34, not shown, is connected to the drive unit. When the agitation screw 34 is rotated by driving the drive unit, the conveyance belt 32 is rotatably driven by the drive shaft 36, and the conveyance coil 31 is rotated through the roller 35. Further, the upper conveyance screw 33 is connected to a driving portion of the agitation screw 34 through a gear. More specifically, the conveyance coil 31, the conveyance belt 32, the upper conveyance screw 33, and the agitation screw 34 are both driven by a common drive unit, resulting in a reduction of the number of parts. Moreover, the common drive unit may be provided in a location other than that described here. For example, if a gear is provided at another end of the conveyance coil 31, not shown, it is possible to connect the drive unit of the photoconductor 2 to the gear.

Figure 7:
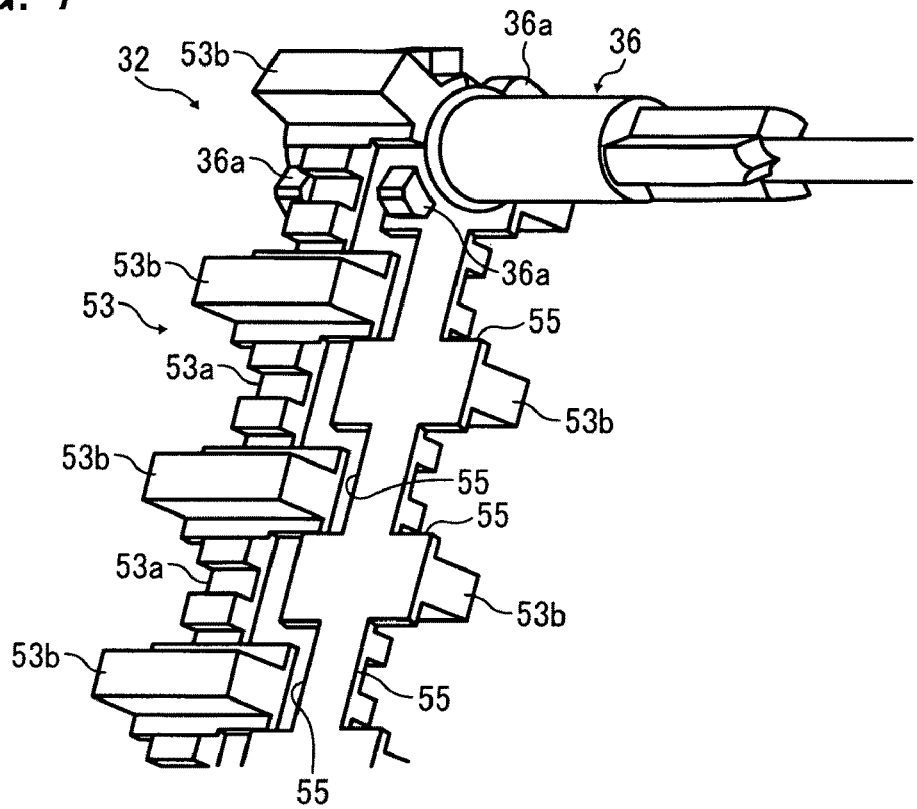
FIG. 7 is a perspective view of a schematic configuration of a conveyance belt of a toner conveyance device incorporated in the image forming apparatus of FIG. 4.
Figure 8:
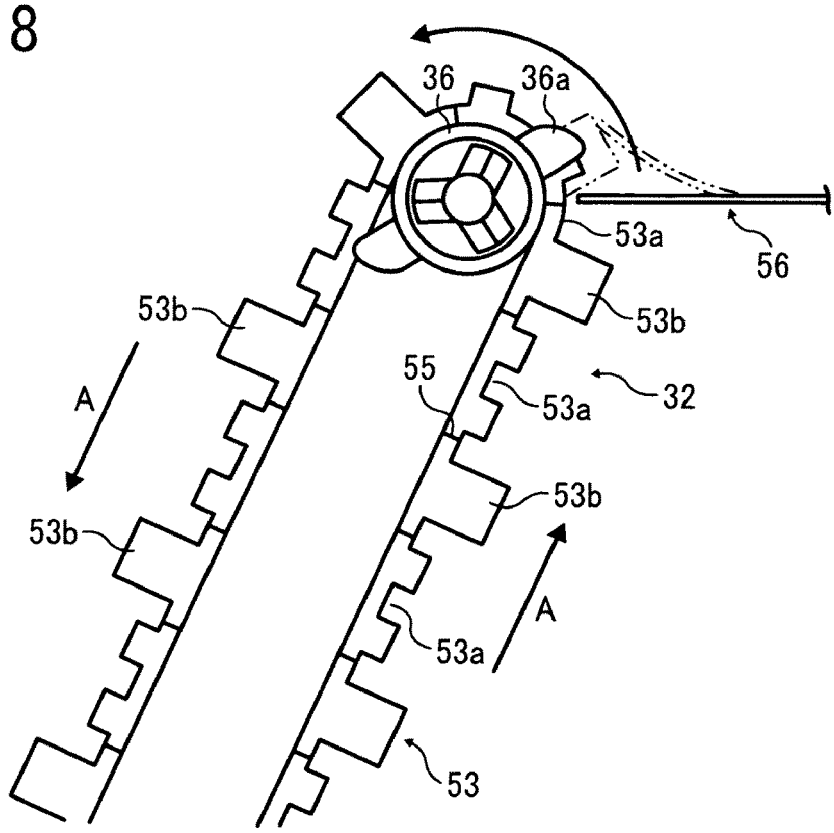
FIG. 8 is a schematic structure representing the conveyance belt of the toner conveyance device of FIG. 7.

As shown in FIGS. 7 and 8, on an outer conveyance surface of the conveyance belt 32, a concavo-convex teeth set 53 is formed by arranging a plurality of depressions 53*a* and projections 53*b* alternately at regular intervals in a running direction of the conveyance belt 32. The toner T is held and conveyed between the projections 53*b* and a wall surface 39*a* of the toner conveyance path 39, through a small gap provided between the projection 53*b* on the conveyance belt 32 and the wall surface 39*a* of the toner conveyance path 39.

Further, as shown in FIGS. 7 and 8, projections 36*a* are formed on an outer surface of the drive shaft 36. At both side portions of the conveyance belt 32, engagement grooves 55 are formed at predetermined intervals in the running direction of the conveyance belt 32. Accordingly, when the drive shaft 36 is driven to rotate, the engagement grooves 55 engage the projection 36*a* of the drive shaft 36 to provide a driving force to the conveyance belt 32.

As shown in FIG. 8, a scraper 56 is provided at a position close to an upper position of the conveyance belt 32 to touch the conveyance belt 32 so as to scratch the toner T adhered on the conveyance belt 32 off. The scraper 56 is a thin plate with an elastic body formed of, for example, polyethylene terephthalate (PET). When the projections 53*b* of the conveyance belt 32 touch the scraper 56, the scraper 56 is deformed elastically as shown by a virtual line in FIG. 8. Accordingly, it is possible to scratch the toner T adhered on the conveyance belt 32 off.

A waste toner conveyance process performed by the toner conveyance device 22 will be now explained.

First, as shown in FIG. 5, the toner removed from the surface of the photoconductor 2 by the cleaning blade 5 is dropped into and stored in the toner receiving unit 38. When the conveyance coil 31 is rotated, the toner in the toner receiving unit 38 is conveyed in a direction shown by arrow B in FIG. 6. The toner conveyed by the conveyance coil 31 is transferred to the conveyance belt 32 provided at an end portion of the conveyance coil 31. While the conveyance belt 32 is driven to circulate in a direction shown by arrow A in FIG. 6, the toner is conveyed. More specifically, the toner is held by the projections 53*b* and wall surface 39*a* of the toner conveyance path 39 and is conveyed. Then, the toner is dropped into a toner receiving portion 40 at an opening 39*c* formed at an upper part I of the toner conveyance path 39. After that, the toner in the toner receiving portion 40 is conveyed in a direction shown by arrow C in FIG. 6 by the conveyance screw 33 that rotates.

In the example embodiment of the present invention, the toner conveyance direction by the conveyance coil 31 (a direction shown by arrow B in FIG. 6) intersects and is orthogonal to the toner conveyance direction by the conveyance belt 32 (a direction shown by arrow A in FIG. 6). That toner tends to accumulate at the junction between the two conveyance paths, the toner receiving unit 38 and the toner conveyance path 39.

In this example embodiment, as shown in FIG. 6, at a toner delivery portion D where the toner is transferred from the conveyance coil 31 to the conveyance belt 32, an agitator 37 is provided to agitate the toner.

The running direction of the conveyance belt 32 is a direction shown by arrow A in FIG. 8. Thus, a lower-side region H1 and an upper-side region H2 are formed. The conveyance belt 32 runs obliquely upward in the lower-side region H1, and runs obliquely downward in the upper-side region H2. A space S is formed between the lower-side region H1 in which the belt travels upwards and the upper-side region H2 in which the belt travels downwards. In the space S, a generally flat, rib-like guide member 57 is provided to prevent the conveyance belt 32 from entering inside the space S. A running line of the conveyance belt 32 in the lower-side region H1 and a running line of the conveyance belt 32 in the upper-side region H2 are parallel, and tilt at a predetermined angle with respect to the vertical.

An upper part of the guide member 57 is provided relatively close to the drive shaft 36, and an lower part of the guide member 57 is provided at some distance from the driven roller 35.

Since the conveyance belt 32 receives pressure at the drive shaft, a tensile force of the conveyance belt 32 is high at the upstream of the drive shaft 36 (the lower side region H1), and the tensile force of the conveyance belt 32 is low at the downstream of the drive shaft 36 (the upper side region H2). Accordingly, the conveyance belt 32 sags and it may happen that the conveyance belt 32 is caught at a position around the drive shaft 36. For this reason, the guide member 57 is provided to prevent the conveyance belt 32 from being entangled with the drive shaft 36. Further, it is preferable to make a gap between the guide member 57 and the drive shaft 36 as small as possible.

As described previously, since the engagement grooves 55 are formed in the conveyance belt 32, the toner may get into the space S between upper and lower parts of the conveyance belt 32 (between the lower side region H1 and the upper side region H2) through the engagement grooves 55, due to vibration of the conveyance belt 32 in operation or the like. However, if the guide member 57 is provided, the toner T entering from the upper side region H2 is accumulated on a surface 57*a* of the guide member 57 at the upper side region H2 and falls downwards. Further, in a region of the lower side region H1 below the guide member 57, the toner entering the space below the guide member 57 in the lower-side region H1 is discharged through the engagement grooves 55 to an outer surface of the conveyance belt 32, which is at a side of the wall surface 39*a* of the toner conveyance path 39. Accordingly, the toner is not accumulated in an area below the guide member 57 in the lower side region H1.

As for the position from which to drop the toner from the guide member 57, it is preferable that the position be not too far from or too close to the driven roller 35. If the guide member 57 is too far from the driven roller 35, it becomes similar to a condition in which no guide member 57 is provided, and the toner is accumulated in the whole area surrounded by the conveyance belt 32 around the driven roller 35. On the other hand, if the guide member 57 is too close to the driven roller 35, the toner dropping from the guide member 57 enters a space between the driven roller 35 and the conveyance belt 32, which can shift the entrained position of the conveyance belt 32 and is therefore undesirable.

Accordingly, as shown in FIG. 9, the lowest portion 58 of the guide member 57 at the upper side region is placed on a substantially vertical line drawn from a belt delivery part 59 of the driven roller 35 at the lower side region. More specifically, where a radius of the driven roller 35 is "R" and a distance between a shaft center of the driven roller 35 and the lowest portion 58 of the guide member 57 at the upper side region is "L", R is nearly equal to L, that is, $$R \approx L$$

In this embodiment, an outermost part of the driven roller 35 at the lower side region H1 and vicinity may be defined as a belt delivery part 59.

With this configuration, the toner accumulated on the guide member 57 drops in a direction shown by arrow E. Thus, the toner is dropped onto the belt delivery part 59 and the vicinity. When the toner is dropped onto the belt delivery part 59 and the vicinity, the toner T may leave through the engagement grooves 55 in the conveyance belt 32, and is accumulated again between the conveyance belt 32 and the wall surface 39*a* of the toner conveyance path 39 so that the toner is conveyed upwards by the conveyance belt 32.

Figure 10:
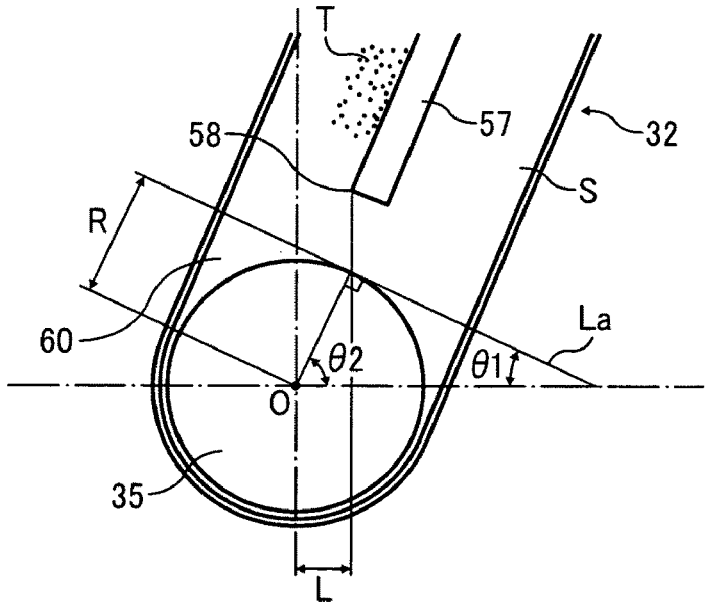
FIG. 10 is a schematic of the relevant part of a guide member showing the lower limit position thereof.

FIG. 10 is a schematic diagram representing a case in which the toner T drops onto a center region of the driven roller 35. In this case, the toner T is caught between the driven roller 35 and the conveyance belt 32. More specifically, the dropped toner T slips down into a belt incursion part 60 and into a space between the driven roller 35 and the conveyance belt 32. On the circumference of a circle of the driven roller 35, there are two positions (circumferential surface of the driven roller 35) onto which the toner is dropped. At one position, (at a side of the belt delivery part 59), the toner is conveyed again. At another position (at a side of a belt incursion part 60), the toner is captured.

Since the toner T is powder, the toner T collapses downward when inclined at a predetermined angle, hereinafter referred to as a "repose angle".

Depending on where the toner T is dropped, whether or not it is conveyed again depends strongly on the repose angle. The repose angle differs according to the type of toner, how badly the toner is degraded, environmental conditions, vibration, and so on. The repose angle of the toner T is generally between 45 degrees and 70 degree under quiescent conditions.

In actual operation, the toner is being moved and is dropped from the guide member 57. Accordingly, an angle θ1 to slip the toner T down is smaller than the repose angle under quiescent conditions. The angle θ1 must be larger than approximately 30 degrees.

If an angle of a tangent line La to the driven roller 35 at a position where the toner is dropped is larger than 30 degrees, the toner T dropped onto the driven roller 35 slips into the a space between the driven roller 35 and the conveyance belt 32. Then, the toner T is dropped onto outer side of the conveyance belt 32 through the engagement grooves 55, and is conveyed by the wall surface 39*a* of the toner conveyance path 39 and the conveyance belt 32.

The position where the tangent line La is touching the driven roller 35 at 30 degrees is half of the radius of the driven roller 35, that is, R/2.

More specifically, when the tangent line La is touching the driven roller 35 at 30 degrees with respect to the horizontal, i.e., θ1 is 30 degrees, L=R×cos 60 because the angle θ2 is (90−θ1). Therefore, L=R/2.

Accordingly, it is preferable that a horizontal distance L between the lowest portion 58 of the guide member 57 at the upper-side region and a shaft center of the driven roller 35 satisfy the following relation:

$$R/2<L \quad (1).$$

Under this relation, the toner T may not enter a space between the driven roller 35 and the conveyance belt 32. Accordingly, it can be avoided that the conveyance belt 32 outward due to the presence of this toner and gets hung up with the wall surface 39*a* of the toner conveyance path 39.

Figure 11:
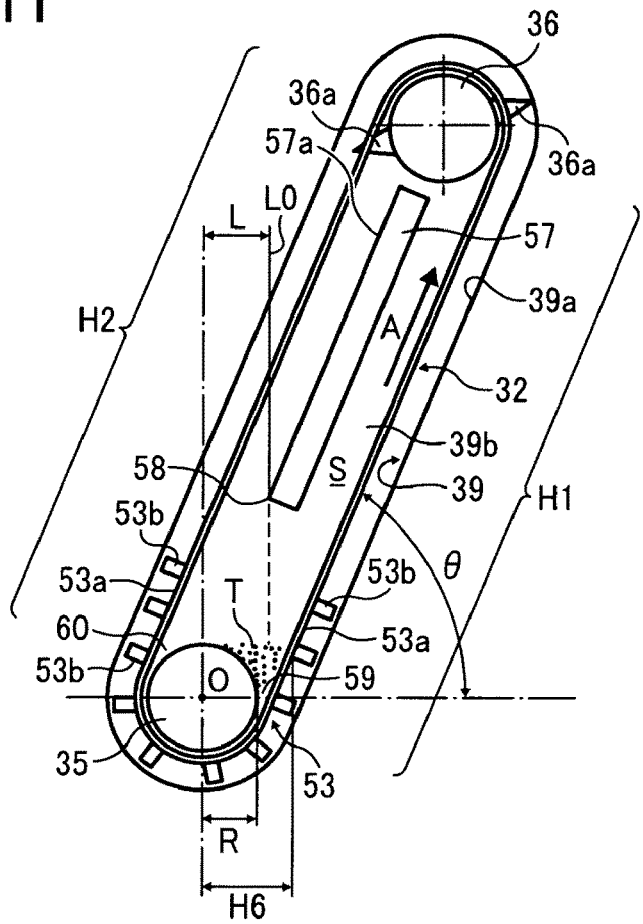
FIG. 11 is a schematic of the relevant part of the guide member of the conveyance belt of the toner conveyance device, showing the upper limit position of the guide member of FIG. 9.
Figure 12:
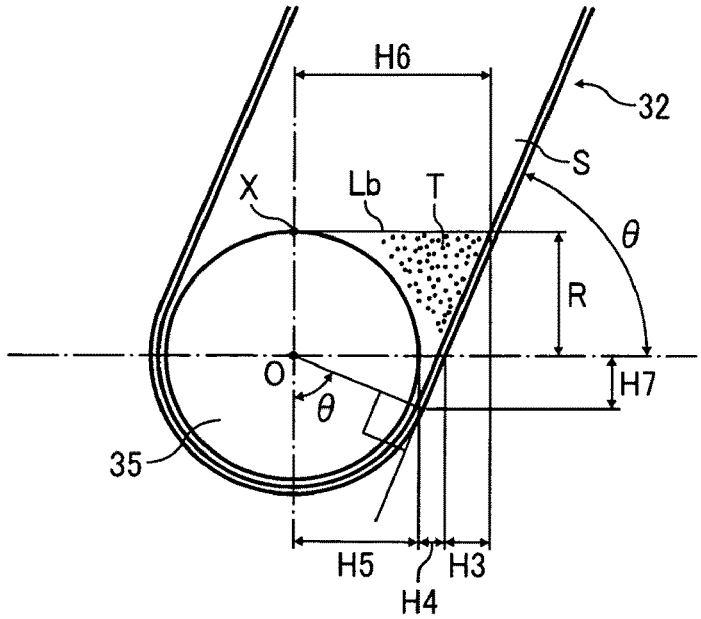
FIG. 12 is a detailed view of the relevant part of the toner conveyance device of FIG. 11.

FIGS. 11 and 12 are schematic diagrams each representing a case in which the vertical line L0, that is, a line passing through the lowest portion 58 of the guide member 57 at the upper side region, deviates outward from the belt delivery part 59 of the driven roller 35. The toner T dropped from the guide member 57 is moved to the toner conveyance path 39 through the engagement grooves 55 in the conveyance belt 32 and is conveyed, however, a portion of the toner T is moved to the driven roller 35 at a lower position. Since toner flow is active at the position where the toner T is dropped, if the toner T adheres to a wall vertical surface 39*b* (wall surface orthogonal to the wall surface 39*a*) of the toner conveyance path 39, the adhered toner T may drop together with the toner T dropping from the guide member 57.

The toner is accumulated gradually due to accumulation of the toner T on the wall, which is not in the toner dropping route. As shown in FIGS. 11 and 12, when a position at which the toner is dropped is apart from a circumferential surface of the driven roller 35 (outer circumferential surface), the toner may be accumulate in a vicinity of the driven roller 35, which is an area restricted by the driven roller 35 and the conveyance belt 32. Further, the toner may accumulate up to a position below the horizontal line drawn from the top portion X of the driven roller 35 as shown in FIG. 12. More specifically, the region where the toner accumulates is an area surrounded by the tangential line Lb drawn for the top portion X of the driven roller 35, the driven roller 35, and the conveyance belt 32.

A horizontal distance H6 is a distance between a position at the conveyance belt 32 up to which the dropping toner accumulates and the center of the driven roller 35, and is expressed as:

$$H6=(\sin\theta+(\cos\theta+1)/\tan\theta)\times R \quad (2),$$

where the radius of the driven roller 35 is "R" and an angle of the conveyance belt 32 with respect to a horizontal line is "θ".

The formula (2) can be derived in the following way. Referring to FIG. 12, H7 is expressed as:

$$H7=R\times\cos\theta \quad (3);$$

H3 is expressed as formula (4), $$H3=R/\tan\theta \quad (4);$$

H4 is expressed as formula (5), $$H4=H7/\tan\theta=R\times\cos\theta/\tan\theta \quad (5);$$

and

H5 is expressed as formula (6), $$H5=R\times\sin\theta \quad (6).$$

Further, H6 is expressed by H6=H3+H4+H5. Accordingly, the dimension H6 is expressed by the formula (2).

To avoid accumulation of the toner T at a region where the toner might normally accumulate, it is necessary to make the toner flow by dropping the toner through such region. Accordingly, it is preferable that $$L<H6,$$

where the distance between a shaft center of the driven roller 35 and the lowest portion 58 of the guide member 57 at the upper side region is L. Further, as described previously, it is preferable to satisfy the relation "R/2<L". Consequently, it is preferable to satisfy the relation expressed as:

$$R/2<L<(\sin\theta+(\cos\theta+1)/\tan\theta)\times R \quad (7).$$

In the toner conveyance device according to the present invention, it becomes possible to prevent the toner from getting into the gap between the conveyance belt 32 and the driven roller 35. As a result, the conveyance belt 32 can circulate stably. Further, it is maintain long-term stable toner conveyance performance.

More specifically, the accumulated toner on the wall surface 39*a* may become an impediment to the movement of the conveyance belt 32, disturbing the smooth movement of the conveyance belt 32. However, using toner conveyance device according to the present invention, it is possible to avoid such an outcome. As a result, it is possible to convey the toner stably.

Further, as for residual toner remaining on the photoconductor after the transfer process, it is to be noted that the fluidity of such toner may be degraded. However, it is possible to stably convey even such residual toner having low fluidity. Consequently, it is possible to print an image with high quality without generation of a toner jam.

In this embodiment, the driven roller 35 serves as a lower holding member. Accordingly, the conveyance belt 32 can be driven smoothly without being disturbed.

By setting the configuration of the toner conveyance device to satisfy the formula (7) described above, it becomes possible to reliably avoid capture of the toner T, resulting in more stable conveyance of the toner T. More specifically, since a movement of the toner T is active in the vicinity of the driven roller 35 where the toner T is being dropped, it becomes possible to prevent the toner T from adhering to the vertical wall surface 39*b*, that is orthogonal to the wall surface 39*a* of the toner conveyance path 39. Further, it is possible that the toner T moves to the toner conveyance path 39 through the engagement grooves formed in the conveyance belt 32, and is conveyed by the conveyance belt 32 by passing over the driven roller 35 without getting into the space between the driven roller 35 and the conveyance belt 32.

Thus, it is possible to adjust an edge portion of the guide member 57 (the lowest portion 58 of the guide member 57 at the upper side region) to a desired position. Consequently, it is possible to obtain an excellent effect, that is, to prevent the toner T from getting into the space between the driven roller 35 and the conveyance belt 32.

Figure 13:
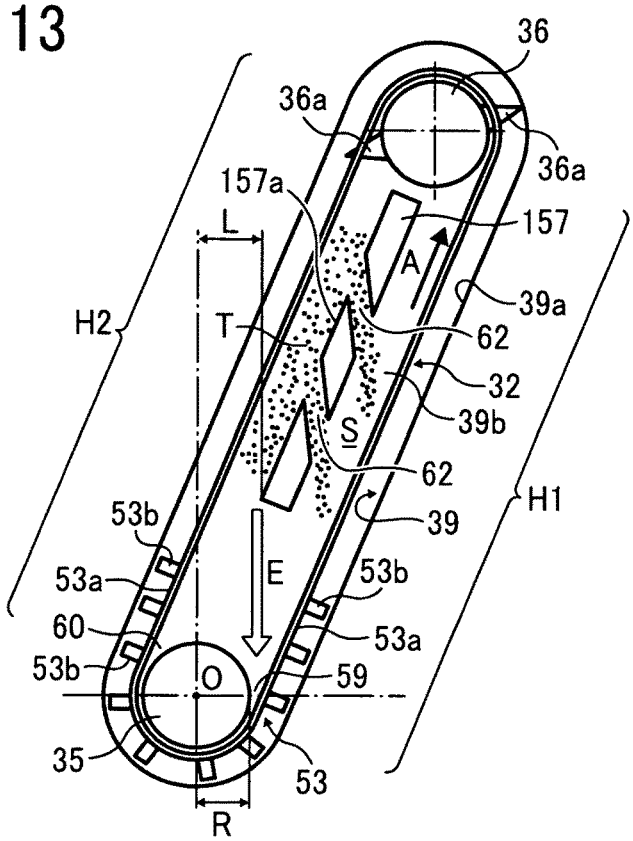
FIG. 13 is a schematic structure of the toner conveyance device according to a second embodiment, representing a modification of the guide member according to the first embodiment.

FIG. 13 is a second embodiment of the toner conveyance device 22. The elements or components of the toner conveyance device 22 according to the second embodiment are similar in structure and functions to the elements or components of the toner conveyance device 22 according to the first embodiment, except that the toner conveyance device 22 according to the second embodiment includes a guide member 157, which is a modification of the guide member 57. The guide member 157 includes a plurality of slits 62 on a surface 157*a* thereof so that the toner can flow from the upper side region H2 to the lower-side region H1.

By providing such slits, while the toner accumulated on the guide member 157 is moved to the driven roller 35, the toner can drop through the slits 62 formed in the middle of the guide member 157. Thus, it is possible to reduce a volume of the toner dropping to the driven roller 35.

As a result, a volume of the toner T around the driven roller 35 is reduced. Accordingly, it is possible to improve the ability to prevent the toner from getting into the space between the driven roller 35 and the conveyance belt 32.

As described, the guide member 157 having slits 62 thereon is suitable for a developing device that includes a guide member having a relatively great length. Further, it is suitable to use the guide member 157 having slits 62 therein in a case in which the toner accumulated on the surface 175*a* of the guide member 157 slips easily. However, if the hole size of each of the slits 62 is made very large or an excessive number of slits is provided, in operation the member provides an effect similar to a state in which the guide member 157 is not provided. Thus, the number of slits 62 and the pitch at which the number of slits 62 are arranged can, within limits, be varied as needed to obtain an desired effect of the slits 62.

Figure 14:
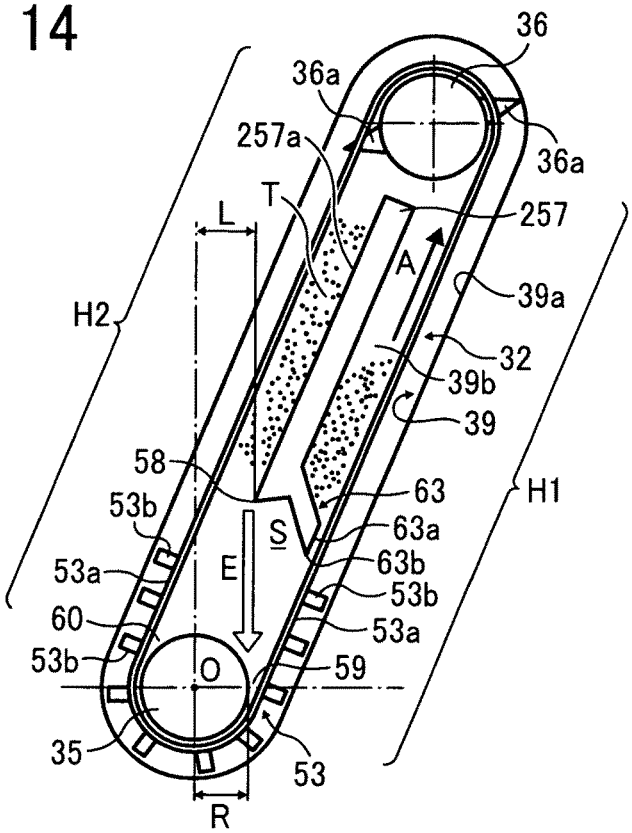
FIG. 14 is a schematic structure of the toner conveyance device according to a third embodiment, representing another modification of the guide member according to the first embodiment.

FIG. 14 is a third embodiment of the toner conveyance device 22. The elements or components of the toner conveyance device 22 according to the third embodiment are similar in structure and functions to the elements or components of the toner conveyance device 22 according to the above-described embodiments, except that the toner conveyance device 22 according to the third embodiment includes a guide member 257 having a surface 257*a*, which is another modification of the guide member 57.

The guide member 257 includes a toner drop guard unit 63. The toner drop guard unit 63 serves as a lower holding member and prevents the toner from dropping onto the driven roller 35 so as to hold the toner flown into a lower region than the guide member 257. More specifically, the toner drop guard unit 63 is formed at lower portion of the guide member 257 and extends towards the conveyance belt 32 in the lower side region H1. A belt facing surface 63*a* of the toner drop guard unit 63 is provided close to or contacting the inner surface of the conveyance belt 32.

The toner drop guard unit 63 is formed from the guide member 257 downwards. The lowest portion of the toner drop guard unit 63 is defined as an edge portion 63*b*.

By introducing the above-described toner drop guard unit 63, it is possible to control a drop amount of the toner T onto the driven roller 35 and to scrape off any toner adhering to the inner surface of the conveyance belt 32, thus reliably preventing the toner from getting into the driven roller 35.

Figure 15:
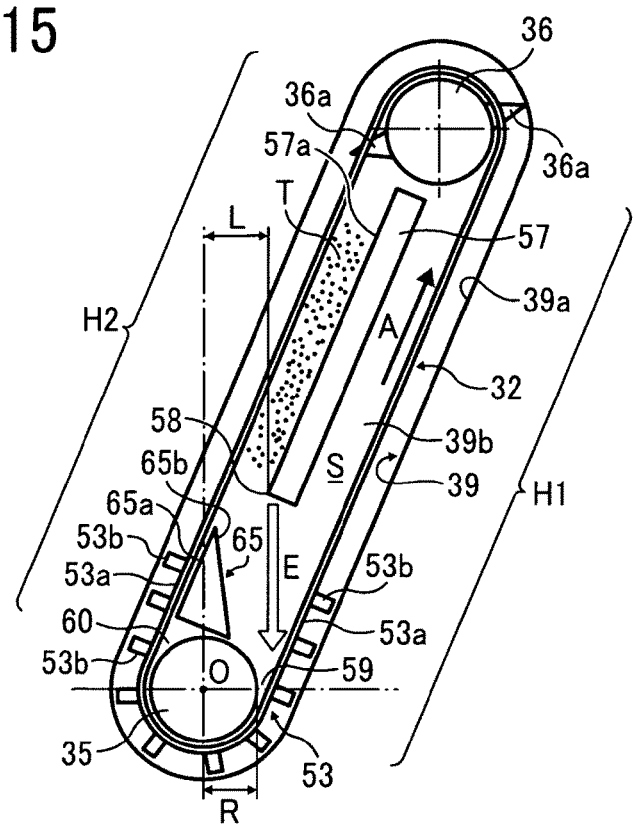
FIG. 15 is a schematic structure of the toner conveyance device according to a fourth embodiment, representing a toner entry prevention unit provided in the toner conveyance device.

FIG. 15 is a fourth embodiment of the toner conveyance device 22. The elements or components of the toner conveyance device 22 according to the fourth embodiment are similar in structure and functions to the elements or components of the toner conveyance device 22 according to the above-described embodiments, except that the toner conveyance device 22 according to the fourth embodiment further includes a toner entry prevention unit 65 that is provided separately from the guide member 57. More specifically, the toner entry prevention unit 65 is provided at a position between the guide member 57 and the driven roller 35.

The toner entry prevention unit 65 includes a toner scratch surface 65*a* and a guide surface 65*b*. The toner scratch surface 65*a* can be moved close to or contacting the inner surface of the conveyance belt 32. The guide surface 65*b* guides the toner T to the belt delivery part 59 of the driven roller 35 at the lower side region of the driven roller 35. By making an angle between the toner scratch surface 65*a* and the guide surface 65*b* an acute angle, it is possible to increase the ability to scrape off any toner T adhering to the inner surface of the conveyance belt 32. As a result, it is possible to scrape off the toner T adhering to the inner surface of the conveyance belt 32, resulting in smooth conveyance belt circulation. Further, the toner T is not dropped onto the belt incursion part 60 from the guide member 57. Accordingly, it is possible to prevent the toner from getting into the driven roller 35.

Figure 16:
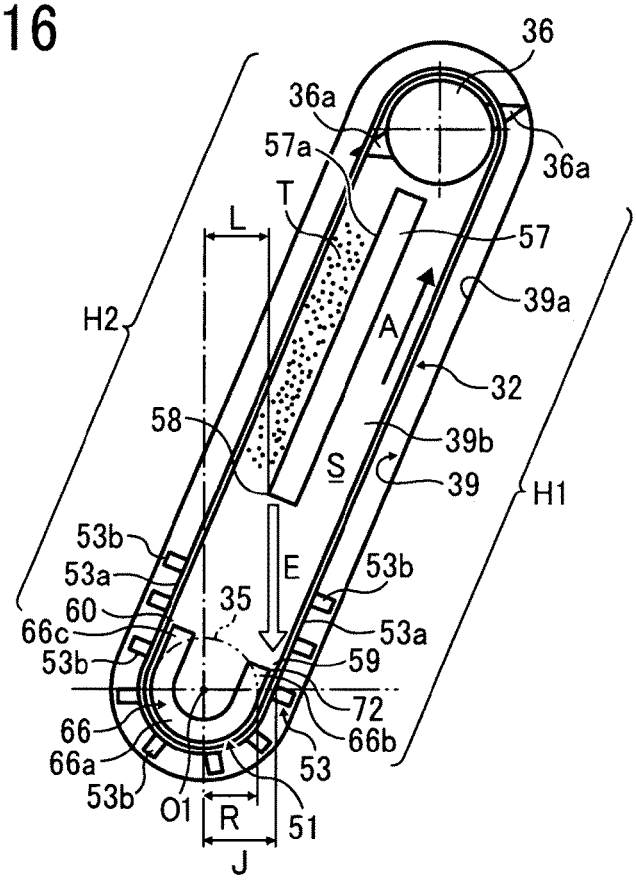
FIG. 16 is a schematic structure of the toner conveyance device according to a fifth embodiment, representing the toner conveyance device employing a lower holding member different from that of the above-described embodiments.

FIG. 16 is a fifth embodiment of the toner conveyance device 22. The elements or components of the toner conveyance device 22 according to the fifth embodiment are similar in structure and functions to the elements or components of the toner conveyance device 22 according to the above-described embodiments, except that the toner conveyance device 22 according to the fifth embodiment includes a U-shaped member 66 serving as a lower holding member. The U-shaped member 66 is a modification of the driven roller 35 according to the embodiments described above. Unlike the driven roller 35 serving as a lower holding member, the U-shaped member 66 does not rotate. The U-shaped member 66 includes a circular arc section 66*a* and a pair of straight sections 66*b* and 66*c* extending from the end portions of the circular arc section 66*a*.

In the fifth embodiment, a radius of curvature of the circular arc section 66*a* of the U-shaped member 66 can be set to match the radius R of the driven roller 35. The inner surface of the conveyance belt 32 slides on an outer surface of the circular arc section 66*a*.

Where a distance between a shaft center O1 of the U-shape member 66 and the lowest portion 58 of the guide member 57 at the upper-side region is L, and a distance between a shaft center O1 of the U-shaped member 66 and an outer edge 72 of the straight section 66*b* of the U-shaped member 66 at the lower-side region H1 is J, L is nearly equal to J, $$L \approx J.$$

In other words, the lowest portion 58 of the guide member 57 at the upper-side region is placed on a substantially vertical line drawn from the belt delivery part 59 of the U-shaped member 66 at the lower-side region H1.

Figure 17:
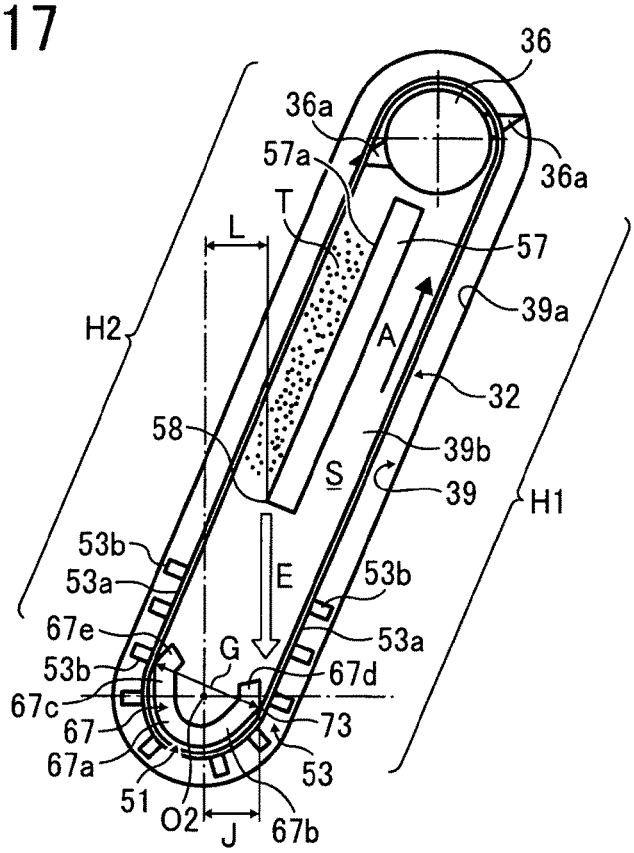
FIG. 17 is a schematic structure of the toner conveyance device according to a sixth embodiment, representing the toner conveyance device employing another lower holding member.

FIG. 17 is a sixth embodiment of the toner conveyance device 22. The elements or components of the toner conveyance device 22 according to the sixth embodiment are similar in structure and functions to the elements or components of the toner conveyance device 22 according to the above-described embodiments, except that the toner conveyance device 22 according to the sixth embodiment includes a V-shaped member 67 serving as a lower holding member. The V-shaped member 67 is a modification of the U-shaped member 66 according to the fifth embodiment. Unlike the driven roller 35 serving as a lower holding member, the V-shaped member 67 does not rotate. The V-shaped member 67 includes a quarter circular arc section 67*a* and a pair of tilted sections 67*b* and 67*c* extending from the ends of the circular arc section 67*a* and having inwardly belt sections 67*d* and 67*e* extending from the ends of the tilt sections 67*b* and 67*c*.

In the sixth embodiment, a radius of curvature of the circular arc section 67*a* of the V-shaped member 67 can be set to match the radius R of the driven roller 35. The inner surface of the conveyance belt 32 slides on an outer surface of the circular arc section 67*a* and an outer surface of the tilt sections 67*b* and 67*c*.

Where a distance between a shaft center O2 of the V-shape member 67 and the lowest portion 58 of the guide member 57 at the upper-side region is L, and a distance between a shaft center O2 of the V-shape member 67 and the outer edge 73 of the tilt section 67*b* of the V-shape member 67 at the lower-side region H1 is J, L is nearly equal to J, $$L \approx J.$$

In other words, the lowest portion 58 of the guide member 57 at the upper-side region H2 is placed on a substantially vertical line drawn from a belt delivery part 59 of the driven roller 35 at the lower-side region H1.

Figure 18:
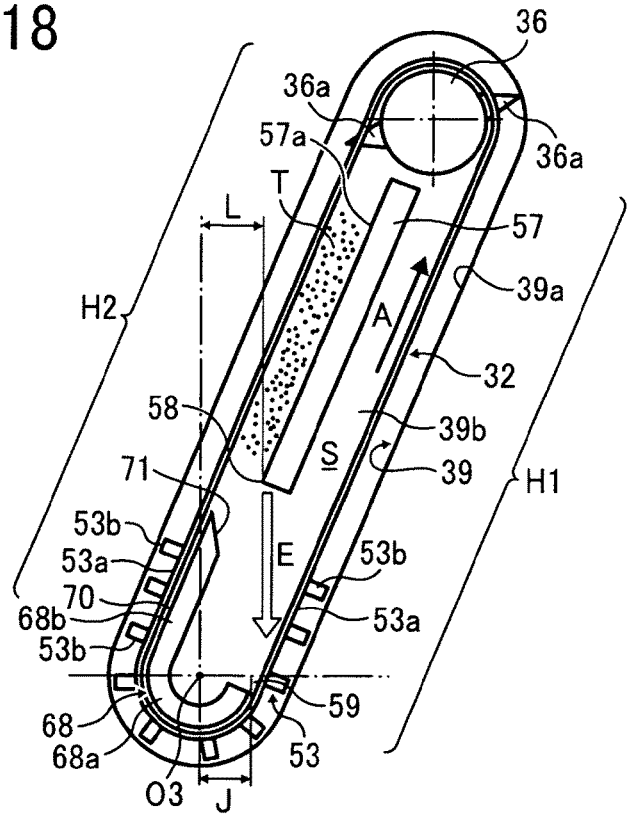
FIG. 18 is a schematic structure of the toner conveyance device according to a seventh embodiment, representing the toner conveyance device employing yet another lower holding member.

FIG. 18 is a seventh embodiment of the toner conveyance device 22. The elements or components of the toner conveyance device 22 according to the seventh embodiment are similar in structure and functions to the elements or components of the toner conveyance device 22 according to the above-described embodiments, except that the toner conveyance device 22 according to the seventh embodiment includes a J-shaped member 68 serving as a lower holding member. The J-shaped member 68 is a modification of the U-shaped member 66 according to the fifth embodiment. Unlike the driven roller 35 serving as a lower holding member, the J-shaped member 68 does not rotate. The J-shaped member 68 includes a half circular arc section 68*a* having a half circular arc and a straight section 68*b* extending from the edge of the half circular arc section 68*a* (from the edge of the at the upper-side region H2).

In the seventh embodiment, a radius of curvature of the half circular arc section 68*a* can be set identical to the radius R of the driven roller 35. The inner surface of the conveyance belt 32 slides on an outer surface of the half circular arc section 68*a*.

Once again, where a distance between a shaft center O3 of the J-shaped member 68 and the lowest portion 58 of the guide member 57 at the upper side region H2 is L, and a distance between a shaft center O3 of the J-shaped member 68 and the outer edge 73 of a straight section 68*b* of the J-shaped member 68 at the lower side region H1 is J, L is nearly equal to J, $$L \approx J.$$

In other words, the lowest portion 58 of the guide member 57 at the upper side region H2 is placed on a substantially vertical line drawn from a belt delivery part 59 of the driven roller 35 at the lower side region H1.

The straight section 68*b* is provided to locate an outer surface 70 of the straight section 68*b* close to or touching the inner surface of the conveyance belt 32 at the upper side region H2. At an edge of the tilt section 68*b*, a guide surface 71 is formed. Accordingly, the straight section 68*b* works similarly to the toner entry prevention unit 65 shown in FIG. 15. In this embodiment, an angle between the outer surface 70 of the straight section 68*b* and the guide surface 71 may be set to an acute angle. As a result, it is possible to increase the ability to scrape off the toner T adhering to the inner surface of the conveyance belt 32. More specifically, in FIG. 18, a horizontal position of the lowest portion 58 of the guide member 57 at the upper-side region H2 is located approximately at the same position horizontally as a top portion of the straight section 68*b* of the J-shaped member 68. Further, the top portion of the straight section 68*b* is provided close to or contacting the inner surface of the conveyance belt 32 at the upper-side region H2.

Furthermore, it is preferable that the configuration of FIGS. 16 and 18 satisfy the following formula (8) corresponding to formula (7):

$$J/2 < L < (\sin\theta + (\cos\theta + 1)/\tan\theta) \times R \quad (8).$$

In FIG. 17, the conveyance belt 32 is extended among the drive shaft 36 and the V-shaped member 67 projected from the wall of the toner conveyance path 39. Accordingly, the portions of the conveyance belt 32 that receives a tensile force do not have a uniform shape, but are straight and R-shaped. In such configuration, an effective region to prevent the dropping toner T from accumulating is expressed as:

$$J/2 < L < (\sin\theta + (\cos\theta + 1)/\tan\theta) \times G \quad (9).$$

where straight-line distance between both ends of an area of the V-shaped member 67 which receives the tensile force is indicated by "G" in FIG. 17.

Thus, the straight-line distance between both ends of the area of the J-shaped member 68 which receives the tensile force corresponds to a diameter of the driven roller 35.

Using the lower holding member shown in FIGS. 16, 17 and 18, it is possible to prevent the toner from getting into. Further, if the lower holding member is formed of the J-shaped member 68 as shown in FIG. 18, it is possible to scratch the toner T adhered on the inner surface of the conveyance belt 32 off, resulting in a smooth conveyance belt operation. Furthermore, the toner T is not dropped onto the belt incursion part 60 from the guide member 57. Accordingly, it is possible to prevent the toner from entering the lower holding member.

A variety of modifications and variations are possible in light of the above teachings.

For example, it is possible to apply the above teachings to a cleaning device for a transfer belt and a toner supply device that conveys new toner.

Numerous additional modifications and variations are possible in light of the above teachings. It is therefore to be understood that within the scope of the appended claims, the disclosure of this patent specification may be practiced otherwise than as specifically described herein.

What is claimed is:

1. A toner conveyance device comprising:

a toner conveyance path configured to convey toner from a lower position to an upper position;

a lower holding member provided at the lower position in the toner conveyance path and defining a belt delivery part;

an upper holding member provided at the upper position in the toner conveyance path;

a conveyance belt extended around the upper holding member and the lower holding member provided in the toner conveyance path and driven to circulate by the upper holding member working in conjunction with the lower holding member, the conveyance belt running obliquely upward at a lower-side region, running obliquely downward at an upper-side region, and including a projection to hold and convey the toner with a wall of the toner conveyance path and engagement grooves communicating an inner side of the conveyance belt with an outer side of the conveyance belt, formed at predetermined intervals in a running direction of the conveyance belt so as to transfer a drive force to the conveyance belt; and a guide member provided in a space inside a circulating loop formed by the conveyance belt to prevent the conveyance belt from collapsing, a lowest portion of the guide member at the upper-side region being placed on a substantially vertical line drawn from the belt delivery part of the lower holding member at the lower-side region.

2. The toner conveyance device according to claim 1, wherein the upper holding member is a drive shaft and the lower holding member is a roller.

3. The toner conveyance device according to claim 2, wherein a configuration of the toner conveyance device satisfies a relation:

$$R/2<L<(\sin\theta+(\cos\theta+1)/\tan\theta)\times R,$$

where the radius of the roller is "R", a distance between a shaft center of the driven roller and the lowest portion of the guide member at the upper-side region is "L", and an angle of the conveyance belt with respect to a horizontal line is "θ".

4. The toner conveyance device according to claim 1, wherein the guide member is a flat, rib like member and includes a plurality of slits through which the toner can flow from the upper-side region to the lower-side region of the conveyance path.

5. The toner conveyance device according to claim 1, wherein the guide member includes a toner drop guard unit formed at lower portion thereof and extending towards the conveyance belt in the lower-side region to prevent toner in a region below the guide member from dropping onto the lower holding member.

6. The toner conveyance device according to claim 1, further comprising a toner entry prevention unit provided at or near an inner surface of the conveyance belt to scrape off toner adhering to the inner surface of the conveyance belt.

7. The toner conveyance device according to claim 1, wherein the lower holding member is a non-rotating member, a configuration of the toner conveyance device satisfying a relation:

$$L\approx J,$$

where a distance between a shaft center of the non-rotating member and the lowest portion of the guide member at the upper-side region is "L" and a distance between the shaft center of the non-rotating member and an outer edge of a straight section of the non-rotating member at the lower-side region is "J".

8. The toner conveyance device according to claim 7, further comprising a toner entry prevention unit provided on the lower holding member.

9. The toner conveyance device according to claim 1, wherein the lower holding member is a non-rotating member, a configuration of the toner conveyance device satisfying a relation:

$$L\approx J,$$

where a distance between a shaft center of the non-rotating member and the lowest portion of the guide member at the upper-side region is "L" and a distance between the shaft center of the non-rotating member and an outer edge of a tilt section of the non-rotating member at the lower-side region is "J".

10. A process unit detachably attachable to an image forming apparatus, the process unit comprising:

an image carrier configured to bear an electrostatic latent image thereon;

a developing unit configured to develop an electrostatic latent image formed on the image carrier; and the toner conveyance device according to claim 1.

11. An image forming apparatus that employs the toner conveyance device according to claim 1.

* * * * *